United States Patent [19]

Drumm

[11] Patent Number: 4,763,378

[45] Date of Patent: Aug. 16, 1988

[54] PUSH BROOM HEAD OF THE CHANNEL-MOUNTED BRISTLE TYPE

[76] Inventor: Arthur E. Drumm, 14808 Hillview Rd., Marysville, Ohio 43040

[21] Appl. No.: 126,246

[22] Filed: Nov. 27, 1987

[51] Int. Cl.[4] ..... A46B 3/08

[52] U.S. Cl. ..... 15/146

[58] Field of Search ..... 15/159 R, 146, 147 R, 15/168, 171, 204, 205, 177, DIG. 6

[56] References Cited

U.S. PATENT DOCUMENTS

| | | | |
|---|---|---|---|
| 964,707 | 7/1910 | Stevens . | |
| 1,761,180 | 6/1930 | Cave et al. . | |
| 2,116,441 | 5/1938 | Mason | 15/146 |
| 2,152,358 | 3/1939 | Palmeri | 15/146 X |
| 2,561,025 | 7/1951 | Le Febvre . | |
| 2,893,044 | 7/1959 | Kurose . | |
| 2,958,888 | 11/1960 | Peterson | 15/204 X |
| 3,619,845 | 11/1971 | Partridge et al. . | |
| 4,218,804 | 8/1980 | Arinci et al. . | |

*Primary Examiner*—Peter Feldman

*Attorney, Agent, or Firm*—William V. Miller

[57] ABSTRACT

A push broom having a head formed from a bristle strip or strips of the type consisting of a channel with U-shaped bristles extending downwardly therefrom and bent into an oval formation with curved ends. The curved ends receive complemental curved clips which are slipped downwardly over the curved channel ends and are clamped thereto. The clips may have depending flanges which overlap the upper portions of the bristles. A reinforcing member may be inserted and clamped in the oval formation. Also a special strong connection may be provided to connect the handle to the head.

15 Claims, 4 Drawing Sheets

FIG. 6
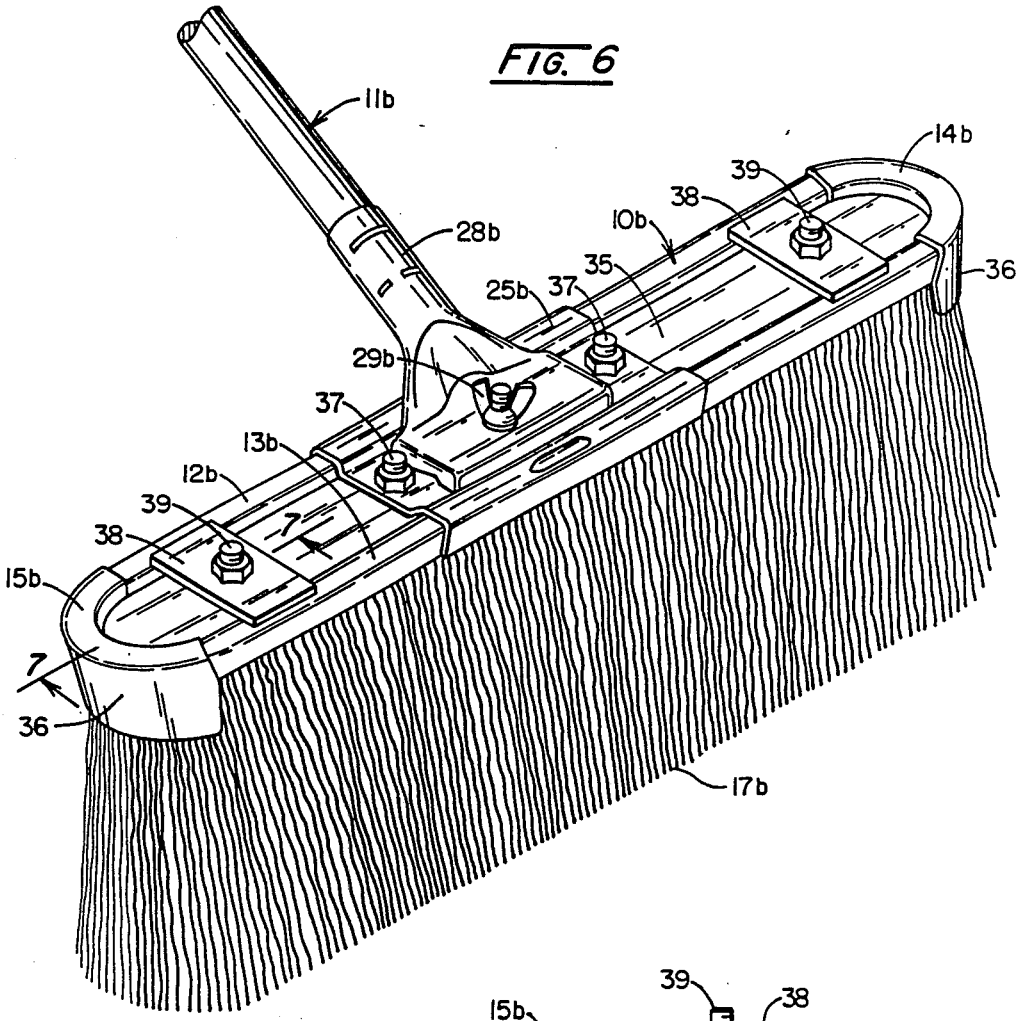
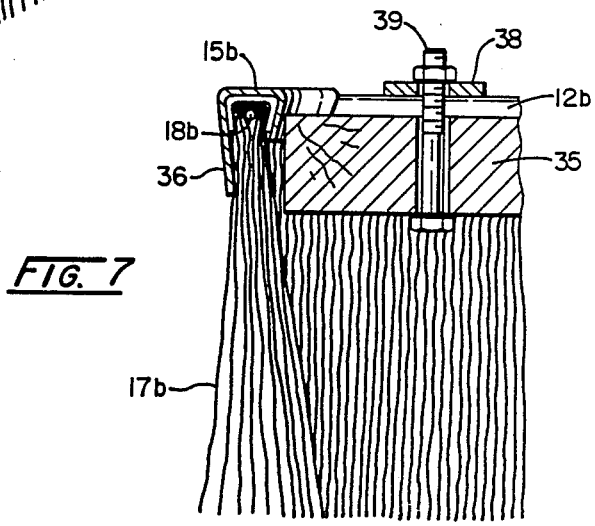
FIG. 7

PUSH BROOM HEAD OF THE CHANNEL-MOUNTED BRISTLE TYPE

FIELD OF THE INVENTION

This invention deals with a push broom which includes a bristle-carrying head and a handle connected thereto. The bristles are U-shaped and have their closed ends inserted in outwardly-opening channels being retained therein by a wire insert extending longitudinally through the closed ends of the bristles to form a bristle strip which is clamped in place in the channel by crimping the sides of the channel. This type of bristle strip assembly is commonly used in the art in forming sweeper heads.

PRIOR ART

Bristle strips of the type indicated are used in forming sweeper heads by bending a strip into oval form and connecting a handle thereto at the mid-point of the oval. This arrangement permits the use of one type of bristles only since they are crimped by a single channel which has its ends meeting at the handle. It is desirable for some uses to have two types of bristles, that is, a leading coarse type and a following finer type but this cannot be accomplished with the usual continuous bristle strip. Another problem encountered in the prior art is the tendency with long bristles at the closed ends of the oval or loop of the bristle strip to bend or flare outwardly and thereby be less effective.

SUMMARY OF THE INVENTION

The present invention provides a sweeper head which is formed of two separate bristle strips of the channel type which are dispersed mainly in parallel relationship but curved inwardly at their opposed ends where they meet in contacting relationship. The meeting ends are held in proper contacting relationship by curved connecting clips which clip onto the meeting curved channel ends and are clamped around such ends. In another aspect of the invention these curved clips have downwardly-extending flanges which overlap the upper portions of adjacent bristles to prevent them from Flaring outwardly which results in them not contacting effectively the surface to be swept.

DETAILED DESCRIPTION OF THE DRAWINGS

The best mode contemplated in carrying out this invention is illustrated in the accompanying drawings in which:

FIG. 6 is a view similar to FIG. 1 but showing longer bristles with clips to prevent flaring thereof at the brush ends and a support for preventing twisting of the oval loop;

FIG. 7 is an enlarged sectional view taken along line 7—7 of FIG. 6;

DETAILED DESCRIPTION OF THE INVENTION

Figure 1:
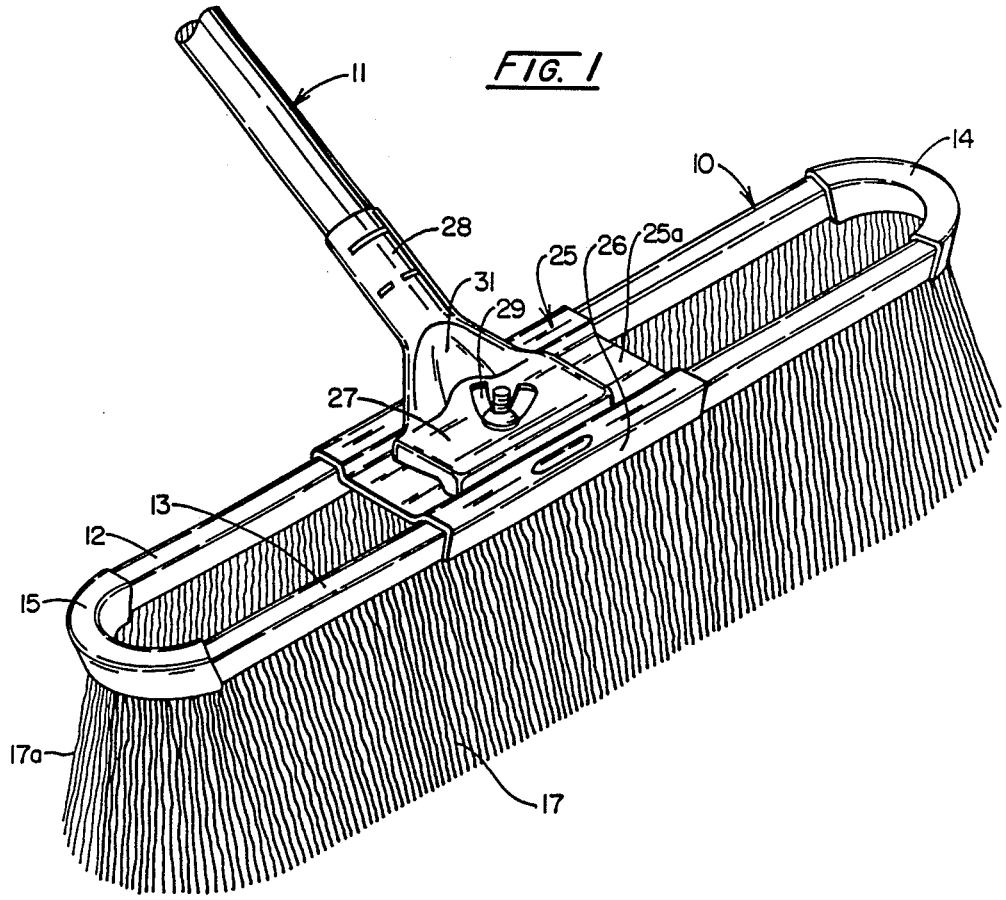
FIG. 1 is a perspective view of a push broom head embodying this invention assembled from two different types of bristle strips.
Figure 2:
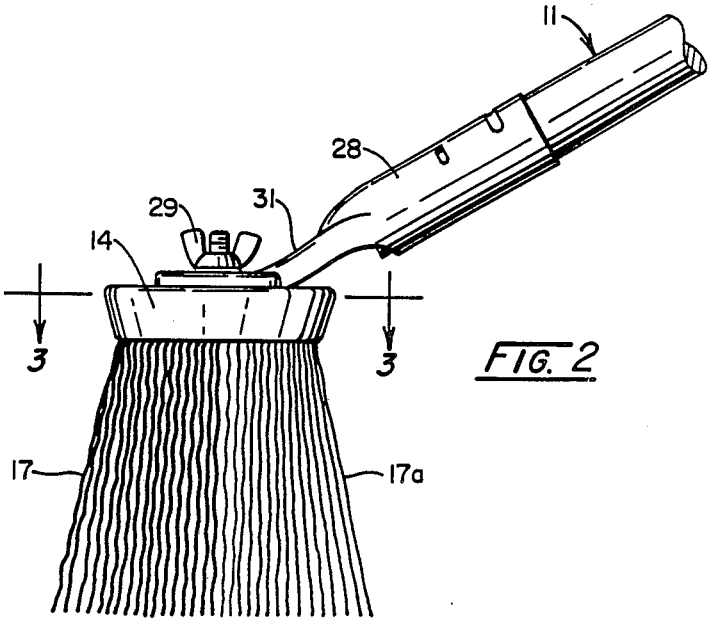
FIG. 2 is view showing one end of the head.
Figure 3:
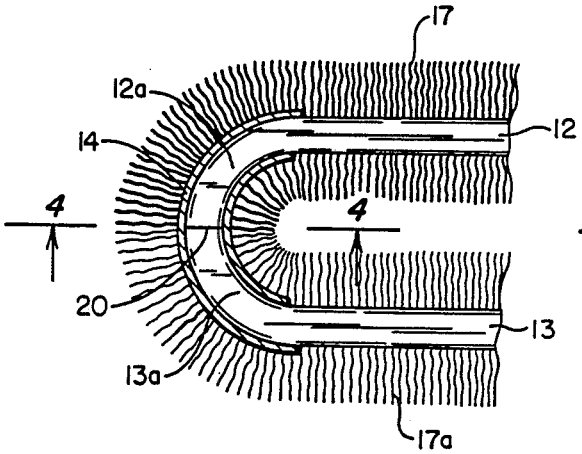
FIG. 3 is a sectional view taken along line 3—3 of FIG. 2.
Figure 5:
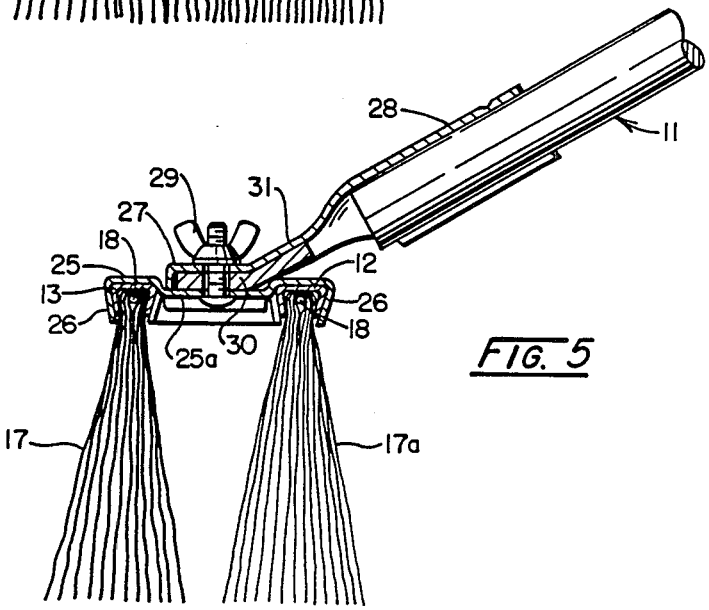
FIG. 5 is a transverse sectional view taken through the head where it is connected to the handle.

With reference to the drawings and particularly to FIGS. 1, 2, and 5 the push broom is shown as comprising a head 10 and a handle 11 connected thereto. The head 10 is made of a pair of bristle strips 12 and 13 connected together at their curved ends by connecting clips 14 and 15.

The strips 12 and 13 are formed in the usual manner and each consists of a downwardly-opening channel 16 (FIG. 4) preferably of metal which has the upper closed ends of the U-shaped bristles 17 inserted therein and held in the channel by a continuous retaining wire 18, the sides of the channel being crimped to hold the bristles in the channel.

Figure 4:
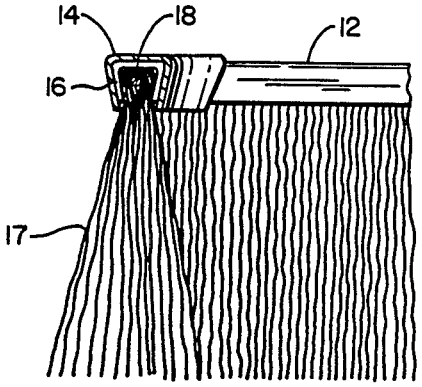
FIG. 4 is a sectional view taken along line 4—4 of FIG. 3.

At each of its ends, each bristle strip 12 or 13 has the ends of its channel bent to curve inwardly as indicated at **12*a* and 13*a* until they contact at a joint 20. At this joint the adjacent curved ends are clamped together by either the clip 14, or clip 15. These curved clips 14 and 15 are preferably of metal and are curved complemental to the curved ends 12*a* and 13*a* of the strips 12 and 13. As shown in FIG. 4 these clips are channel-shaped in cross section complemental to the channels of the strips and will slip downwardly over the channels of the strips to which they are clamped by crimping the channels 16** of the clips over the underlying channels of the strips.

With this arrangement the bristle strips 12 and 13 may carry different types of bristles, for example, the leading bristles 17 (FIG. 5) may be heavier than the trailing bristles **17*a***. One may be plastic and the other wire.

The handle 11 may be of any suitable type and is connected to the head assembly at its midpoint as shown in FIGS. 1 and 5. The connection is preferably made by a connecting plate 25 which is superimposed on the channels of the strips 12 and 13 and which has depending flanges 26 (FIG. 5) that clamp around the channels of the strips 12 and 13. This plate 25 has a flat depressed area **25*a* against which the flat end 27 on the lower portion of a handle-receiving socket member 28 is clamped by a winged nut and bolt 29. The flat end 27 has a rearwardly-opening socket which receives a reinforcing tongue 30 that is angular-shaped to fit the socket in member 27 and the upwardly inclined portion 31 of socket member 28**. This tongue provides a reinforcement at the handle connection to resist the pressure developed in pushing the broom.

Figure 8:
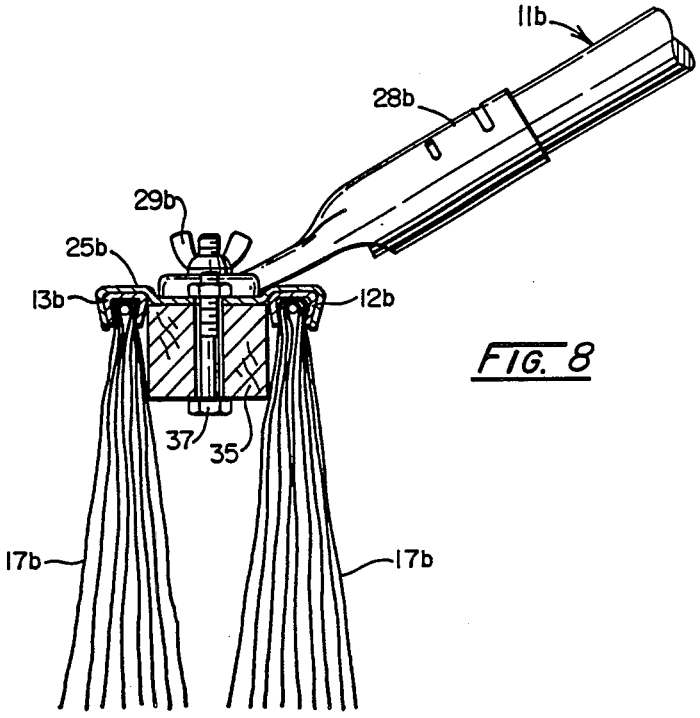
FIG. 8 is a transverse sectional view through the head at the handle connection.

In FIGS. 6, 7 and 8 there is illustrated a broom head **10*b* which is provided with longer bristles 17*b*, clips 14*b* and 15*b* at the ends of a different type to prevent outward flaring of the bristles at the ends of the head, and a reinforcement strip or block 35 which is fitted into the oval assembly to prevent twisting thereof. The bristles carried by the leading and trailing sides of the head 10*b* may be of the same type or of different types similar to the arrangement of FIGS. 1 and 2. The clips 14*b* and 15*b* are identical to the clips 14 and 15 of FIGS. 1 and 2 except that the outer flanges 36 of the channels thereof are extended downwardly to a substantial extent into overlapping relationship with the upper portions of the bristles 17*b* at the ends of the brush head 10*b*. These extensions 36** will resist the tendency of the longer bristles at the ends of the brush head to flare outwardly and decrease the effectiveness of the bristles at the brush ends.

Figure 9:
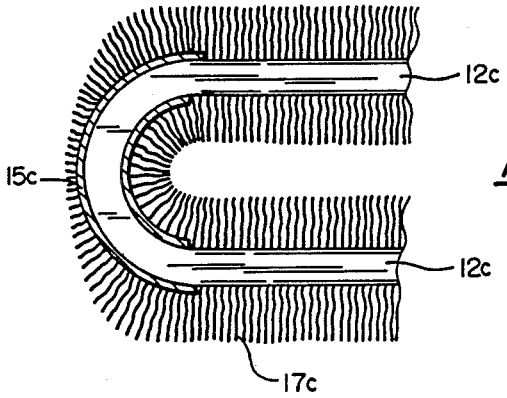
FIG. 9 is a view similar to FIG. 3 but showing the bristle strip continuous at its ends.

The handle 11*b* is attached to the brush head 10*b* in the same manner as before by means of the plate 25*b* except that the bolt of the wing nut unit 29*b* also passes through the reinforcement block or strip 35 as shown in FIGS. 8 and 9 and additional bolts 37 are passed through member 25*b* into and through the underlying member 35.

The block or strip 35 is of substantial thickness and is of a proper length with curved ends to fit snugly between the parallel portions and curved ends of the respective brush sections 12*b* and 13*b* of the brush head 10*b*. Additional end clamping clips 38 may be provided to bridge the space over the member 35 and rest on the bristle strip channels 12*b* and 13*b* for receiving clamping bolts 39 which extend downwardly through the member 35 as shown in FIG. 7.

With this arrangement the oval assembly produced by the bristle strips 12*b* and 13*b* is reinforced to prevent twisting by the member 35 inserted therein. This arrangement would be for heavy duty. The tendency for the bristles 17*b* at the curved end of the oval assembly to flare outwardly is resisted by the overlapping extensions 36 of the connecting clips 14*b* and 15*b*. Also the handle connection is reinforced by member 35.

In FIG. 9 the bristle strip 12*c* is shown as a strip which is continuous at the curved ends with the brush head. The ends of the strip will meet under a handle connecting member (not shown) which is like member 25*b*. The curved clip at each end of the oval will be like the clip 14*b* or 15*b* of FIG. 6, one clip only being shown at 15*c*. This clip will have the downward extension which overlaps the upper portion of the bristles 17*c*. The clips in this instance are not used as connecting clips but do provide means at curved ends of the brush head to reduce outward flaring of the bristles.

It will be apparent that this invention provides a push broom in which the bristle strip or strips are arranged in oval form in a head which may be reinforced by an insert and in which the handle connection may be strengthened. At each end of oval head clips are provided which are complemental to the curved ends of the bristle strip channel or channels and which fit over those ends and are clamped thereto. These clips may serve as connecting clips for the meeting ends of the channels and may be provided with downward extensions which overlap the upper ends of the bristles to reduce the tendency for them to flare outwardly reducing their efficiency.

Having thus described the invention what is claimed is:

1. A push broom comprising a brush head formed with opposed substantially parallel bristle strip sections joined at curved opposite ends of the head, said bristle strip sections being composed of a downwardly opening channel which receives and retains the U-shaped upper ends of depending bristles, and end clips of channel form complemental to that of the bristle strip sections fitting downwardly over the sections at the curved ends.

2. A push broom according to claim 1 in which the clips have an outer flange which extends downwardly over the upper portions of the adjacent depending bristles.

3. A push broom brush head according to claim 1 in which the opposed bristle strip sections are a pair of separate sections which have their respective ends curved inwardly into substantially meeting relationship at a joint, the curved end clips being complementally curved to fit over the curved ends of the bristle sections.

4. A head according to claim 3 in which the downwardly-opening channels of the bristle strip sections receive the downwardly opening channel clips which are clamped thereto to connect the adjacent meeting curved ends of the bristle sections.

5. A head according to claim 4 in which the channels of the bristle sections have inner and outer flanges and the clips have overlapping inner and outer flanges, the outer flanges of the clips extending downwardly substantially below the adjacent outer flanges of the bristle sections into overlapping relationship with the depending bristles thereof.

6. A head according to claim 4 in which the separate bristle sections carry bristles which are different from each other.

7. A head according to claim 6 in which the channels of the bristle sections have inner and outer flanges and the clips have overlapping inner and outer flanges, the outer flanges of the clip extending downwardly substantially below the adjacent outer flanges of the bristle sections into overlapping relationship with the depending bristles thereof.

8. A push broom having a head as claimed in claim 1 and a handle connected thereto by a connecting plate which extends over the opposed channels of the parallel bristle channel sections and has depending flanges overlapping and clamped to the outer flanges of the bristle sections.

9. A push broom according to claim 8 in which the connecting plate carriers an upwardly and rearwardly inclined handle-receiving socket portion.

10. A push broom according to claim 9 in which the socket portion has a flattened lower end portion clamped to the plate by a bolt unit, the flattened end portion having a rearwardly-opening channel socket which receives a reinforcing tongue through which the bolt of the bolt unit passes.

11. A push broom according to claim 9 in which the flattened end portion is connected to the handle-socket portion by an inclined connecting portion, the reinforcing tongue being angled to extend from its channel socket under the inclined connection portion.

12. A push broom according to claim 8 in which the opposed bristle sections and end clips form a substantially oval head, and a reinforcing strip fitted within the oval, and means for clamping the reinforcing strip to the opposed bristle strips.

13. A push broom according to claim 12 in which the reinforcing strip is clamped to the handle-connecting plate which extends over it.

14. A push broom according to claim 13 in which the handle-connecting plate is clamped to the reinforcing strip by clamping bolts extending through the plate and strip.

15. A push broom according to claim 14 in which bridging connecting clips extend over the channels of the opposed bristle strips and are clamped thereto and to the underlying reinforcing strip.

* * * * *